US007484337B2

(12) United States Patent
Hecht

(10) Patent No.: US 7,484,337 B2
(45) Date of Patent: Feb. 3, 2009

(54) FLOOR PANEL AND METHOD OF LAYING A FLOOR PANEL

(75) Inventor: Hendrik Hecht, Potsdam (DE)

(73) Assignee: Kronotec. AG, Luzern (CH)

( * ) Notice: Subject to any disclaimer, the term of this patent is extended or adjusted under 35 U.S.C. 154(b) by 925 days.

(21) Appl. No.: 10/704,130

(22) Filed: Nov. 10, 2003

(65) Prior Publication Data

US 2004/0128934 A1 Jul. 8, 2004

(30) Foreign Application Priority Data

Nov. 15, 2002 (DE) ..... 102 53 236

(51) Int. Cl.

| | |
|---|---|
| ***E04C 3/00*** | (2006.01) |
| ***E04C 3/30*** | (2006.01) |
| ***E04B 2/00*** | (2006.01) |
| ***E04B 2/08*** | (2006.01) |

(52) U.S. Cl. ..... 52/578; 52/588.1; 52/589.1; 52/590.2; 52/592.1

(58) Field of Classification Search ..... 52/578
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |

(Continued)

FOREIGN PATENT DOCUMENTS

| | | |
|---|---|---|
| AT | 005566 | 8/2002 |

(Continued)

OTHER PUBLICATIONS

"Polygon." Dictionary.com Unabridged (v 1.1). Random House, Inc. Sep. 18, 2007. <Dictionary.com http://dictionary.reference.com/browse/polygon>.*

(Continued)

*Primary Examiner*—Richard E Chilcot, Jr.
*Assistant Examiner*—Branon C Painter
(74) *Attorney, Agent, or Firm*—Greenblum & Bernstein, P.L.C.

(57) ABSTRACT

A floor panel including structure for releasably connecting at least two panels. A tongue is formed extending in the longitudinal direction of the side edge and corresponding recess is formed opposite it. The recess comprises a top lip and a bottom lip, and the bottom lip forms a shoulder with a front shoulder side. The shoulder blocks the panels in the transverse direction. An undercut is adjoined by a recess, with a bearing region which corresponds to the shoulder, and a wall, which, with the front shoulder side in the installed state, is located opposite the latter. Form-fitting elements are formed on the wall and the front shoulder side that, in the installed state, engage one inside the other and bring about locking in the vertical direction. An underside of the tongue and a top side of the bottom lip runs parallel to the top side.

49 Claims, 8 Drawing Sheets

U.S. PATENT DOCUMENTS

| | | | | |
|---|---|---|---|---|
| 1,510,924 | A | | 10/1924 | Daniels et al. |
| 1,540,128 | A | | 6/1925 | Houston |
| 1,575,821 | A | | 3/1926 | Daniels |
| 1,602,256 | A | | 10/1926 | Sellin |
| 1,602,267 | A | | 10/1926 | Karwisch |
| 1,615,096 | A | | 1/1927 | Meyers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,776,188 | A | | 9/1930 | Langb'aum |
| 1,778,069 | A | | 10/1930 | Fetz |
| 1,779,729 | A | | 10/1930 | Bruce |
| 1,787,027 | A | | 12/1930 | Wasleff |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 5/1933 | Potvin |
| 1,921,164 | A | | 8/1933 | Lewis |
| 1,929,871 | A | | 10/1933 | Jones |
| 1,940,377 | A | | 12/1933 | Storm |
| 1,946,648 | A | | 2/1934 | Taylor |
| 1,953,306 | A | | 4/1934 | Moratz |
| 1,986,739 | A | | 1/1935 | Mitte |
| 1,988,201 | A | | 1/1935 | Hall |
| 2,023,066 | A | | 12/1935 | Curtis et al. |
| 2,044,216 | A | | 6/1936 | Klages |
| 2,065,525 | A | | 12/1936 | Hamilton |
| 2,123,409 | A | | 7/1938 | Eimendorf |
| 2,220,606 | A | | 11/1940 | Malarkey et al. |
| 2,276,071 | A | | 3/1942 | Scull |
| 2,280,071 | A | | 4/1942 | Hamilton |
| 2,324,628 | A | | 7/1943 | Kähr |
| 2,328,051 | A | | 8/1943 | Bull |
| 2,398,632 | A | | 4/1946 | Frost et al. |
| 2,430,200 | A | | 11/1947 | Wilson |
| 2,740,167 | A | | 4/1956 | Rowley |
| 2,894,292 | A | | 7/1959 | Gramelspacker |
| 3,045,294 | A | | 7/1962 | Livezey, Jr. |
| 3,100,556 | A | | 4/1963 | De Ridder |
| 3,125,138 | A | | 3/1964 | Bolenbach |
| 3,182,769 | A | | 5/1965 | De Ridder |
| 3,203,149 | A | | 8/1965 | Soddy |
| 3,204,380 | A | | 9/1965 | Smith et al. |
| 3,267,630 | A | | 8/1966 | Omholt |
| 3,282,010 | A | | 11/1966 | King, Jr. |
| 3,310,919 | A | | 3/1967 | Bue et al. |
| 3,347,048 | A | | 10/1967 | Brown et al. |
| 3,460,304 | A | | 8/1969 | Braeuninger et al. |
| 3,481,810 | A | | 12/1969 | Walte |
| 3,526,420 | A | | 9/1970 | Brancaleone |
| 3,538,665 | A | | 11/1970 | Gohner |
| 3,553,919 | A | | 1/1971 | Omholt |
| 3,555,762 | A | | 1/1971 | Costanzo, Jr. |
| 3,608,258 | A | | 9/1971 | Spratt |
| 3,694,983 | A | | 10/1972 | Couquet |
| 3,714,747 | A | | 2/1973 | Curran |
| 3,720,027 | A | | 3/1973 | Christensen |
| 3,731,445 | A | | 5/1973 | Hoffmann et al. |
| 3,759,007 | A | | 9/1973 | Thiele |
| 3,760,548 | A | | 9/1973 | Sauer et al. |
| 3,768,846 | A | | 10/1973 | Hensley et al. |
| 3,859,000 | A | | 1/1975 | Webster |
| 3,878,030 | A | | 4/1975 | Cook |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,006,048 | A | | 2/1977 | Cannady, Jr. et al. |
| 4,037,377 | A | * | 7/1977 | Howell et al. ..... 52/309.9 |
| 4,090,338 | A | | 5/1978 | Bourgade |
| 4,091,136 | A | | 5/1978 | O'Brian et al. |
| 4,099,358 | A | | 7/1978 | Compaan |
| 4,118,533 | A | | 10/1978 | Hipchen et al. |
| 4,131,705 | A | | 12/1978 | Kubinsky |
| 4,164,832 | A | | 8/1979 | Van Zandt |
| 4,169,688 | A | | 10/1979 | Toshio |
| 4,242,390 | A | | 12/1980 | Nemeth |
| 4,243,716 | A | | 1/1981 | Kosaka et al. |
| 4,245,689 | A | | 1/1981 | Grard et al. |
| 4,246,310 | A | | 1/1981 | Hunt et al. |
| 4,290,248 | A | | 9/1981 | Kemerer et al. |
| 4,299,070 | A | | 11/1981 | Oltmanns et al. |
| 4,316,351 | A | * | 2/1982 | Ting ..... 52/309.9 |
| 4,426,820 | A | | 1/1984 | Terbrack et al. |
| 4,431,044 | A | | 2/1984 | Bruneau |
| 4,471,012 | A | | 9/1984 | Maxwell |
| 4,501,102 | A | | 2/1985 | Knowles |
| 4,561,233 | A | | 12/1985 | Harter et al. |
| 4,585,685 | A | | 4/1986 | Forry et al. |
| 4,612,745 | A | | 9/1986 | Hovde |
| 4,641,469 | A | | 2/1987 | Wood |
| 4,653,242 | A | | 3/1987 | Ezard |
| 4,654,244 | A | | 3/1987 | Eckert et al. |
| 4,703,597 | A | | 11/1987 | Eggemar |
| 4,715,162 | A | | 12/1987 | Brightwell |
| 4,738,071 | A | | 4/1988 | Ezard |
| 4,752,497 | A | | 6/1988 | McConkey et al. |
| 4,769,963 | A | | 9/1988 | Meyerson |
| 4,819,932 | A | | 4/1989 | Trotter, Jr. |
| 4,831,806 | A | | 5/1989 | Niese et al. |
| 4,845,907 | A | | 7/1989 | Meek |
| 4,905,442 | A | | 3/1990 | Daniels |
| 4,947,602 | A | | 8/1990 | Pollasky |
| 5,029,425 | A | | 7/1991 | Bogataj |
| 5,103,614 | A | | 4/1992 | Kawaguchi et al. |
| 5,113,632 | A | | 5/1992 | Hanson |
| 5,117,603 | A | | 6/1992 | Weintraub |
| 5,136,823 | A | | 8/1992 | Pellegrino |
| 5,165,816 | A | | 11/1992 | Parasin |
| 5,179,812 | A | | 1/1993 | Itill |
| 5,205,091 | A | | 4/1993 | Brown |
| 5,216,861 | A | | 6/1993 | Meyerson |
| 5,251,996 | A | | 10/1993 | Hiller et al. |
| 5,253,464 | A | | 10/1993 | Nilsen |
| 5,274,979 | A | * | 1/1994 | Tsai ..... 52/588.1 |
| 5,283,102 | A | | 2/1994 | Sweet et al. |
| 5,295,341 | A | | 3/1994 | Kajiwara |
| 5,335,473 | A | | 8/1994 | Chase |
| 5,348,778 | A | | 9/1994 | Knipp et al. |
| 5,349,796 | A | | 9/1994 | Meyerson |
| 5,390,457 | A | | 2/1995 | Sjölander |
| 5,413,834 | A | | 5/1995 | Hunter et al. |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,567,497 | A | | 10/1996 | Zegler et al. |
| 5,570,554 | A | | 11/1996 | Searer |
| 5,597,024 | A | | 1/1997 | Bolyard et al. |
| 5,630,304 | A | | 5/1997 | Austin |
| 5,653,099 | A | | 8/1997 | MacKenzie |
| 5,671,575 | A | | 9/1997 | Wu |
| 5,694,734 | A | | 12/1997 | Cercone et al. |
| 5,706,621 | A | | 1/1998 | Pervan |
| 5,736,227 | A | | 4/1998 | Sweet et al. |
| 5,768,850 | A | | 6/1998 | Chen |
| 5,797,175 | A | | 8/1998 | Schneider |

5,797,237 A 8/1998 Finkell, Jr.
5,823,240 A 10/1998 Bolyard et al.
5,827,592 A 10/1998 Van Gulik et al.
5,860,267 A 1/1999 Pervan
5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A 12/1999 Moriau et al.
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,363,677 B1 4/2002 Chen et al.
6,397,547 B1 6/2002 Manrtensson
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Peopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,641,629 B2 11/2003 Safta et al.
6,646,088 B2 11/2003 Fan et al.
6,647,689 B2 * 11/2003 Pletzer et al. ..... 52/592.1
6,647,690 B1 * 11/2003 Martensson ..... 52/601
6,649,687 B1 11/2003 Gheewala et al.
6,659,097 B1 12/2003 Houston
6,672,030 B2 1/2004 Schulte
6,681,820 B2 1/2004 Olofsson
6,682,254 B1 1/2004 Olofsson et al.
6,775,545 B2 1/2004 Chen et al.
6,685,993 B1 2/2004 Hansson et al.
6,711,864 B2 3/2004 Erwin
6,711,869 B2 3/2004 Tychsen
6,715,253 B2 4/2004 Pervan
6,722,809 B2 * 4/2004 Hamberger et al. ..... 403/329
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
6,862,857 B2 * 3/2005 Tychsen ..... 52/582.1
2001/0029720 A1 10/2001 Pervan
2001/0034992 A1 11/2001 Pietzer et al.
2002/0007608 A1 1/2002 Pervan
2002/0007609 A1 1/2002 Pervan
2002/0014047 A1 2/2002 Thiers
2002/0020127 A1 * 2/2002 Thiers et al. ..... 52/403.1
2002/0046528 A1 4/2002 Pervan et al.
2002/0056245 A1 5/2002 Thiers
2002/0106439 A1 8/2002 Cappelle
2002/0106680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0101681 A1 * 6/2003 Tychsen ..... 52/783.1
2003/0115812 A1 6/2003 Pervan
2003/0115821 A1 6/2003 Pervan
2003/0154681 A1 * 8/2003 Pietzer et al. ..... 52/578
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0128934 A1 7/2004 Hecht
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan
2004/0211143 A1 10/2004 Hanning
2004/0237447 A1 12/2004 Thiers et al.
2004/0237448 A1 12/2004 Thiers et al.
2004/0241374 A1 12/2004 Thiers et al.

| | | | |
|---|---|---|---|
| 2004/0244322 | A1 | 12/2004 | Thiers et al. |
| 2004/0250493 | A1 | 12/2004 | Thiers et al. |
| 2004/0255541 | A1 | 12/2004 | Thiers et al. |
| 2004/0258907 | A1 | 12/2004 | Kornfalt et al. |
| 2005/0003149 | A1 | 1/2005 | Kornfalt et al. |
| 2005/0016099 | A1 | 1/2005 | Thiers |
| 2004/0123547 | A1 | 7/2005 | Grafenauer |

FOREIGN PATENT DOCUMENTS

| | | | |
|---|---|---|---|
| AU | 713628 | | 5/1998 |
| AU | 200020703 | | 1/2000 |
| BE | 417526 | | 9/1936 |
| BE | 557844 | | 6/1957 |
| BE | 557844 | | 3/1960 |
| BE | 09600527 | | 6/1998 |
| BE | 09700344 | | 10/1998 |
| CA | 991373 | | 6/1976 |
| CA | 2226286 | | 12/1997 |
| CA | 2252791 | | 5/1999 |
| CA | 2289309 | | 7/2000 |
| CH | 200949 | | 1/1939 |
| CH | 211877 | | 1/1941 |
| CH | 562377 | | 5/1975 |
| DE | 314207 | | 9/1919 |
| DE | 531989 | | 8/1931 |
| DE | 740235 | | 10/1943 |
| DE | 1089966 | | 9/1960 |
| DE | 1534278 | | 2/1966 |
| DE | 1212225 | | 3/1966 |
| DE | 1212275 | | 3/1966 |
| DE | 1534802 | | 4/1970 |
| DE | 7102476 | | 6/1971 |
| DE | 2007129 | | 9/1971 |
| DE | 1534278 | | 11/1971 |
| DE | 2252643 | | 10/1972 |
| DE | 2238660 | | 2/1974 |
| DE | 7402354 | | 5/1974 |
| DE | 2502992 | | 7/1976 |
| DE | 2616077 | | 10/1977 |
| DE | 2917025 | | 11/1980 |
| DE | 29 16 482 | A1 | 12/1980 |
| DE | 7911924 | | 3/1981 |
| DE | 7928703 | | 5/1981 |
| DE | 3041781 | | 6/1982 |
| DE | 3214207 | | 11/1982 |
| DE | 8226153 | | 1/1983 |
| DE | 3343601 | | 6/1985 |
| DE | 86040049 | | 6/1986 |
| DE | 3512204 | | 10/1986 |
| DE | 3246376 | | 2/1987 |
| DE | 4004891 | | 9/1990 |
| DE | 4002547 | | 8/1991 |
| DE | 4134452 | | 4/1993 |
| DE | 4215273 | | 11/1993 |
| DE | 4242530 | | 6/1994 |
| DE | 4011656 | | 1/1995 |
| DE | 4324137 | | 1/1995 |
| DE | 4107151 | | 2/1995 |
| DE | 29517128 | | 2/1996 |
| DE | 4242530 | | 9/1996 |
| DE | 3544845 | | 12/1996 |
| DE | 29710175 | | 9/1997 |
| DE | 19616510 | | 3/1998 |
| DE | 19651149 | | 6/1998 |
| DE | 19709641 | | 9/1998 |
| DE | 19718319 | | 11/1998 |
| DE | 19735189 | | 6/2000 |
| DE | 20001225 | | 8/2000 |
| DE | 19925248 | | 12/2000 |
| DE | 20017461 | | 3/2001 |
| DE | 20018284 | | 3/2001 |
| DE | 10138285 | A1 * | 8/2001 |
| DE | 20021779 | | 5/2002 |
| DE | 20206460 | | 8/2002 |
| DE | 20218331 | | 5/2004 |
| EP | 0248127 | | 12/1987 |
| EP | 0623724 | | 11/1994 |
| EP | 0652340 | | 5/1995 |
| EP | 0667936 | | 8/1995 |
| EP | 0690185 | | 1/1996 |
| EP | 0849416 | | 6/1998 |
| EP | 0698162 | | 9/1998 |
| EP | 0903451 | | 3/1999 |
| EP | 0855482 | | 12/1999 |
| EP | 0877130 | | 1/2000 |
| EP | 0969163 | | 1/2000 |
| EP | 0969164 | | 1/2000 |
| EP | 0974713 | | 1/2000 |
| EP | 0843763 | | 10/2000 |
| EP | 1200690 | | 5/2002 |
| EP | 0958441 | | 7/2003 |
| EP | 1026341 | | 8/2003 |
| EP | 1367194 | | 12/2003 |
| ES | 163421 | | 9/1968 |
| ES | 460194 | | 5/1978 |
| ES | 283331 | | 5/1985 |
| ES | 1019585 | | 12/1991 |
| ES | 1019585 | | 1/1992 |
| ES | 2168045 | | 5/2002 |
| FI | 843060 | | 8/1984 |
| FR | 1293043 | | 4/1962 |
| FR | 2691491 | | 11/1983 |
| FR | 2568295 | | 5/1986 |
| FR | 2623544 | | 5/1989 |
| FR | 2630149 | | 10/1989 |
| FR | 2637932 | | 4/1990 |
| FR | 2675174 | | 10/1991 |
| FR | 2667639 | | 4/1992 |
| FR | 2691491 | | 11/1993 |
| FR | 2697275 | | 4/1994 |
| FR | 2712329 | | 5/1995 |
| FR | 2776956 | | 10/1999 |
| FR | 2781513 | | 1/2000 |
| FR | 2785633 | | 5/2000 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1033866 | | 6/1966 |
| GB | 1034117 | | 6/1966 |
| GB | 1044846 | | 10/1966 |
| GB | 1237744 | | 6/1968 |
| GB | 1127915 | | 9/1968 |
| GB | 1275511 | | 5/1972 |
| GB | 1399402 | | 7/1975 |
| GB | 1430423 | | 3/1976 |
| GB | 2117813 | | 10/1983 |
| GB | 2126106 | | 3/1984 |
| GB | 2152063 | | 7/1985 |
| GB | 2238660 | | 6/1991 |
| GB | 2243381 | | 10/1991 |
| GB | 2256023 | | 11/1992 |
| JP | 54-65528 | | 5/1979 |
| JP | 57-119056 | | 7/1982 |
| JP | 59-186336 | | 10/1984 |
| JP | 3-169967 | | 7/1991 |
| JP | 4-106264 | | 4/1992 |
| JP | 5-148984 | | 6/1993 |
| JP | 6-56310 | | 5/1994 |
| JP | 6-146553 | | 5/1994 |
| JP | 6-200611 | | 7/1994 |
| JP | 6-320510 | | 11/1994 |
| JP | 7-76923 | | 3/1995 |
| JP | 7-180333 | | 7/1995 |

| | | |
|---|---|---|
| JP | 7-300979 | 11/1995 |
| JP | 7-310426 | 11/1995 |
| JP | 8-109734 | 4/1996 |
| JP | 8-270193 | 10/1996 |
| NE | 7601773 | 2/1976 |
| NO | 157871 | 2/1988 |
| NO | 305614 | 6/1999 |
| RU | 363795 | 12/1972 |
| SE | 7114900-9 | 9/1974 |
| SE | 450411 | 6/1987 |
| SE | 450141 | 9/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 94126999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 9940273 | 8/1999 |
| WO | 99/66151 | 12/1999 |
| WO | 9966152 | 12/1999 |
| WO | 0006854 | 2/2000 |
| WO | 0066856 | 11/2000 |
| WO | 0166876 | 9/2001 |
| WO | WO 01/75247 A1 | 10/2001 |
| WO | 03/016654 | 2/2003 |

OTHER PUBLICATIONS

Webster Dictionary, p. 862.

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner 1
2
15
51
62
64
66
71
72
73
75
80

FLOOR PANEL AND METHOD OF LAYING A FLOOR PANEL

BACKGROUND OF THE INVENTION

1. Field of the Invention

The invention relates to a floor panel and to a method of laying a floor panel.

2. Background Description

WO 01/75247 A1 discloses a floor panel which, on a first side edge, has connecting means for locking in the transverse and vertical directions. These locking means are arranged on the longitudinal side of the panel and bring about locking by the connecting means being introduced and pivoted into a corresponding recess of a second panel. The transverse side of the panel has two snap-in hooks which, when the panels are laid, are intended to engage in corresponding undercuts of an adjacent panel and to hinder the vertical movement between the laid panels. The two snap-in hooks are located vertically one above the other.

The disadvantage with such a profile is the fact that, in order to ensure a minimal joint on the surface of the panel, the connecting means on the longitudinal side have to be designed such that there is prestressing in the connection since, otherwise, there is too great a gap between two laid panels, and dirt and moisture can penetrate therein, which results in the panel core swelling up. Furthermore, prestressing within the profile has the disadvantage that the panels are difficult to lay if this prestressing is too great. It is also disadvantageous that pivoting about an axis parallel to the first side edge can easily take place since the tongue and recess is designed in the form of a circle arc.

Furthermore, DE 29 16 482 A1 discloses a rectangular panel which is intended for a floor covering and has connecting means for a groove/tongue connection of two adjacent panels which allows the panels to be laid such that they are secured against displacement. The disadvantage here is the risk that the connection between two panels can easily be released in an undesirable manner.

SUMMARY OF THE INVENTION

Taking this prior art as the departure point, the object of the invention is to provide a panel which allows straightforward and secure laying and, at the same time, realizes a minimal joint between two panels.

This object is achieved according to the invention by a floor panel having the features of claim 1. The methods of laying such a panel allow quick and straightforward laying, the durable latching between the panels being ensured.

Advantageous configurations and developments of the invention are given in the dependent subclaims. The panels could also be used as wall or ceiling panels or as structural panels or the like.

Providing corresponding form-fitting elements on a front shoulder side and a wall which adjoins an undercut and a bearing region achieves the situation where additional locking is produced in the vertical direction when these form-fitting elements, in the installed state, engage one inside the other. A second locking point in the vertical direction makes it possible for an effective connection already to be carried out successfully by introduction and pivoting-in movements about a first side edge. The tongue and the grooves themselves need not be designed such that there is prestressing between the panels, with the result that the profile as a whole is subjected to less loading when the panels are laid. This additionally results in the laying operation as such being simplified.

Designing the underside of the tongue and the top side of the bottom lip parallel to the top side of the panels allows one group of panels to bear over a large surface area on the other panels, with the result that there is low surface pressure prevailing in the groove/tongue connection and only a very small vertical offset of the panels in relation to one another can be realized.

A development provides that the form-fitting element on the wall is a protrusion and that on the front shoulder side is a corresponding recess, these having been produced by a corresponding milling-out operation.

For locking in the vertical direction on the first side edge, it is provided that, in the installed state, a top side of the tongue butts against an underside of the top lip, in order to bring about further form-fitting locking.

A development of the invention provides that a tongue is formed on the first side edge, the tongue extending in the longitudinal direction of the side edge, and a recess which corresponds to the tongue is formed on the opposite side edge, the tongue being designed such that locking takes place by an introduction movement into the recess of the second panels and a pivoting-in movement about an axis parallel to the first side edge. Designing the connecting elements on the first side edge as a so-called pivoting profile allows a straightforward and secure laying and effective locking in the vertical and transverse directions. As a result of doing away with elastic deformation during laying of the panels by means of a pivoting-in movement, the material structure of the panels is maintained and good strength of the connection is ensured. Overall, it is possible to execute more stable locking via such a pivoting-in profile, with the same amount of force being exerted, during laying of the panels.

Designing the recess as a groove with a top lip and a bottom lip ensures that the panels which are to be laid are positioned securely with respect to one another, with the result that it is possible to achieve a minimal vertical offset of the panels, this being a quality feature of the floor panels. The tongue can be latched in the recess in the transverse direction, the tongue and the recess having a wedge-shaped contour in cross section in order to allow easy introduction and to achieve good self-centering of the tongue in the groove.

In order to accommodate any abraded material which may be produced during laying of the first side edges, without this material forcing the panels apart from one another, the tongue and the recess are designed such that, in the installed state, a gap is present between the front region of the tongue and that region of the recess which adjoins the top lip, it being possible for the abraded material to collect in the gap, and the latter serving as a clearance for the two panels in relation to one another. The gap tapers in the direction of the front shoulder of the bottom lip in order to provide a smooth transition between the full-surface-area abutment regions and free space for movement and for collecting abraded material. Any abraded material present may likewise be accommodated in a free space which is formed by an undercut between the tongue and the top side of the panels.

The distal end of the tongue is designed vertically and serves as a termination of the first side edge. Correspondingly, the groove base is likewise designed perpendicularly to the top side, this making it possible for the panels to be positioned to good effect in the transverse direction.

Form-fitting elements for locking in the vertical direction with a further panel are formed on a third side edge, which runs at an angle to the first side edge, these form-fitting elements being spaced apart from one another in the transverse direction and in the vertical direction on two spaced-apart, essentially vertically oriented walls. This results in two spatially separated locking locations on the third side edge, in particular the transverse side, and this ensures more secure locking of panels which have been positioned against one another and laid. Arranging the form-fitting elements on two different walls increases the stability of the connection as a whole and prevents deformation and abrasion of the form-fitting elements due to a plurality of form-fitting elements arranged one behind the other sliding on one another. This ensures that the locking is effective.

In one configuration of the invention, the third side edge has a step-like milled relief which starts from the underside and has an inner wall and an outer wall. In each case one form-fitting element which extends in the transverse direction is formed on these walls, preferably milled out of the same, and these engage in corresponding undercuts of a step-like milled relief which starts from the top side and belongs to the second panels which are to be connected. The step-like milled relief which starts from the top side likewise has an inner wall and an outer wall, on which the corresponding undercuts are formed, with the result that there may be form-fitting locking in the vertical direction on the third side edge.

The step-like milled relief which starts from the underside has a shoulder which projects in the direction of the underside and forms an essentially horizontally oriented head surface, this shoulder providing effective locking in the transverse direction perpendicular to the third side edge. The essentially horizontally oriented head surface serves for setting the minimal vertical offset and constitutes a relatively large bearing surface for the introduction of vertically acting forces.

The walls of the shoulder are oriented at an acute angle in relation to the head surface, which results either in easy introduction into a corresponding recess of the corresponding milled relief of the second panels or else, in the case of an undercut being formed in relation to the head surface, in an additional locking action.

It has been found that a transverse extent of the head surface in a range of 2 mm to 6 mm provides very good durability and a very good locking action, the head surface preferably having 0.25 to 0.4 times the overall transverse extent of the step-like milled relief.

Particularly effective and straightforward locking on the third side edge is achieved when a form-fitting element projects horizontally beyond the termination edge of the top side. It may be expedient here for a recess, which undercuts the termination edge of the panels, to be arranged between the top side and the projecting form-fitting element, in order to accommodate any possible abraded material or deforming material of the panels, with the result that it is possible for the panels to be laid as accurately as possible with a minimal gap width since there is no abraded or deformed material performing a blocking action.

The fourth side edge of the panels, which is located opposite the third side edge, has a step-like milled relief which starts from the top side and has a shoulder which projects in the direction of the top side. This shoulder likewise has an essentially horizontally oriented head surface, the bottom region of the outer shoulder wall containing an undercut which corresponds with the corresponding form-fitting element of the inner wall of the side edge which is to be accommodated. Arranging the recess in the bottom region of the outer shoulder wall increases the effectiveness of the locking.

One development provides that a horizontal base surface is formed between the inner shoulder wall and the inner wall of the milled relief, said base surface being designed such that, when the panels have been laid, the head surface rests on the base surface and the top sides of the panels are located in a single plane, which means that there is only a minimal vertical offset, if any at all, between the panels. The interaction of horizontal base surfaces and head surfaces allows particularly precise positioning and setting of the vertical offset, and the angling tendency of adjacent panels is reduced, which increases the locking strength.

The inner shoulder wall of the milled relief which starts from the top side runs parallel to, or at a shallower angle than, the corresponding inner shoulder wall of the shoulder which engages in the laid state, in order either to bring about precise abutment or to provide a movement component for the two panels in the transverse direction toward one another.

An additional locking action is achieved by the inner shoulder wall forming an undercut in relation to the head surface of the corresponding shoulder.

In order to bring about particularly straightforward laying, the upwardly projecting shoulder of the milled relief which starts from the top side, rather than being formed over the entire length of the third side edge, is milled off, or not formed, down to the base surface, in particular at an end region of the third side edge which is oriented in the direction of the first side edge, which is provided with a tongue. The removal or non-formation of the projecting shoulder facilitates the pivoting-in movement about the axis parallel to the first side edge, with the result that a blocking action by the form-fitting elements only takes place when the panels which are adjacent to one another on the third and fourth side edges are located at an acute angle in relation to one another. This means that it is only necessary to cover a short distance in the vertical direction in order for the panels to be fully locked on the third and fourth side edges.

A development of the invention provides that at least one tongue is formed on the third side edge, which runs at an angle to the first side edge, and at least one groove with a first lip and a second lip is formed on the opposite, fourth side edge, in each case at least one recess which runs parallel to the top side being arranged on the tongue and at least on one of the lips. The recesses are arranged in relation to one another such that, when the panels have been correctly connected to one another, they form a channel for accommodating a separate locking element. This configuration makes it possible to use a conventional tongue/groove configuration for locking in the vertical direction, as have been used for decades for floor panels which are adhesively bonded to one another. The locking in the vertical direction is brought about by the locking element being pushed in, this resulting in stress-free and thus straightforward installation of the third and/or fourth side edge of a panel. It is likewise the case that the profile is not damaged and the profile is easy and cost-effective to produce.

The recesses are preferably congruent to one another, with the result that it is possible to use a symmetrical locking element, which is likewise cost-effective to produce. It is advantageous, in particular, if the channel formed by the recesses is cylindrical since the full symmetry of the channel allows the locking element to be pushed in particularly easily. Triangular or quadrilateral and polygonal X-shaped or V-shaped channels are envisaged, and suitable, as an alternative. If the channel is of non-round cross section, an interlocking effect is established once the locking element has been pushed in, with the result that it is possible to increase the transmittable forces at the connecting location.

In order to achieve secure locking of all the panels, it is provided that the channel runs over the entire length of the groove and tongue, as a result of which the force-transmitting surface area is increased. The channel preferably runs beneath and parallel to the joint of the panels, in order for it to be possible to absorb and introduce forces as closely as possible to the joint of the panels.

A variant of the invention provides that the groove and the tongue are designed such that they bring about locking in the transverse direction, this resulting in a so-called laying profile in the case of which one panel can be introduced into the other from above, but displacement in the laying plane is not possible. This ensures particularly precise positioning of the panels in relation to one another, and a very large bearing surface, with a simultaneously straightforward profile configuration, is realized. Pushing an advantageously plastic or metal locking element into the recess or into the channel, with corresponding dimensioning of the locking element, produces a force component in the transverse direction, with the result that the joint is minimized. Depending on the material configuration and dimensioning, there may be elastic prestressing between the panels on the third and/or fourth side edge.

It is advantageous for the first side edge to be formed on the longitudinal side, and for the second side edge to be formed on the transverse side, of the panel, with the result that the pivoting-in movement takes place via the longitudinal side. This ensures that a long locking length is achieved by means of the secure and stable pivoting-in locking. As an alternative, it is provided that the tongue and the groove, corresponding to the tongue on the opposite side surface, is formed on the transverse side and form-fitting locking takes place via introduction into a milled relief made on the longitudinal side.

Particularly stable locking of two floor panels is achieved by one side edge being formed with a tongue, the tongue being designed such that locking takes place by an introduction movement into a recess of the second panels and a pivoting-in movement about an axis parallel to the first side edge. These introduction and pivoting-in movements give rise to locking both in the transverse direction and in the vertical direction, the recess being designed as a groove with a top lip and a bottom lip, in which the tongue can be latched in the transverse direction. The bottom front region is of rounded design, and this front region is adjoined by a flattened, essentially horizontally running supporting region, which increases the effective bearing surface area. This supporting region likewise gives rise to the two panels being positioned as precisely as possible in relation to one another, with the result that a maximum level of accuracy is achieved in respect of the vertical offset, as is a minimal angling tendency.

An advantageous embodiment of the invention provides that the floor panel is produced, at least in part, from an HDF or MDF material. As an alternative, it is possible for the entire floor panel to be produced from an OSB material. Using an OSB material achieves a natural-wood appearance and a structured surface. By contrast, it is possible for the top side of the panels, rather than having a decorative layer, to be produced from a wood-based material. The structure of the wood-based material may render a decorative layer superfluous, with the result that, as the top side, it is also possible to apply, for example, a layer of wood, wood fibers or wood chips. It is likewise possible for the panels to be formed wholly or partially from a plastic material, the region of the connecting means with tongue and recess (groove) preferably being produced from a plastic material.

A method of laying a floor panel provides that, in the first instance, a plurality of panels are connected and locked on their second side edges for the purpose of setting down a first row on the floor of a room. Thereafter, a further panel is connected and locked, by way of its first side edge, on at least one panel set down in the row, in order to start a second row by introducing, and pivoting, the tongue into the corresponding groove. A new panel is arranged, by way of its second side edge, in direct abutment against the side edge which is located opposite the second side edge of the previously set-down, further panel in the second row, the tongue being introduced into the groove and the new panel being located at an angle to the first row of set-down panels.

The new panel is then pivoted, about an axis parallel to the first side edge, in the direction of the floor until the form-fitting elements of the second side edge of the new panel butt against the corresponding milled relief of the further panel. Finally, the new panel is pushed downward until form-fitting locking has taken place over the entire length of the second side edge. A development provides that the pushing-down action preferably takes place abruptly, in particular by means of one or more hammer blows or using the ball of the thumb.

An alternative laying method provides that the new panel is arranged at a distance between the third side edge and the fourth side edge of a previously set-down, further panel, the tongue not being introduced into the groove. The new panel is located at an angle to the first row of set-down panels. The new panel is then pivoted, about an axis parallel to the first side edge, in the direction of the floor and displaced along the first side edge until the tongue is accommodated in the groove, with a joint and a channel being formed in the process. A locking element is then pushed into the channel and locking is produced in the transverse direction along the first side edge.

With the profile of the third and fourth side edges being configured such that the groove and tongue leads to locking in the transverse direction, a new panel is arranged, by way of its third side edge, in direct abutment against the fourth side edge of the previously set-down, further panel, the tongue being introduced into the groove and the new panel being located at an angle to the first set-down panels. The new panel is then pivoted, about an axis parallel to the first side edge, in the direction of the floor until the tongue is accommodated in the groove, with a joint and a channel being formed in the process. A locking element is then pushed into the channel in order to lock the panels and to prevent a pivoting-up movement in the horizontal direction.

The method of unlocking a floor panel without separate locking means provides that, in the first instance, a row of panels which are connected on the third and fourth side edges is pivoted about the axis parallel to the first side edge, that is to say preferably parallel to the longitudinal sides. The pivoting gives rise to unlocking on this side edge, and the panels can be removed from the groove of the still laid row of panels. The panels belonging to the removed row are still connected to one another on the third and fourth side edges, preferably transverse sides. In order to separate the panels, one panel of the row is pivoted about an axis parallel to the third or fourth side edge. If the row is located on the floor, the locked end is raised, with the result that the angle between the underside of the panels is reduced and the locking location is displaced away from the floor. The form-fitting elements of the panel are thus disengaged from the form-fitting elements of the corresponding milled relief of the other panel, without the form-fitting elements being destroyed, and the separated panel can be removed.

BRIEF DESCRIPTION OF THE DRAWINGS

An exemplary embodiment of the invention will be described with reference to the attached figures, in which the same designations are used to designate the same objects, and in which:

FIGS. 11-14 show variants of the configuration of the groove and tongue and with locking elements pushed in.

DETAILED DESCRIPTION OF EMBODIMENTS OF THE INVENTION

Figure 1:
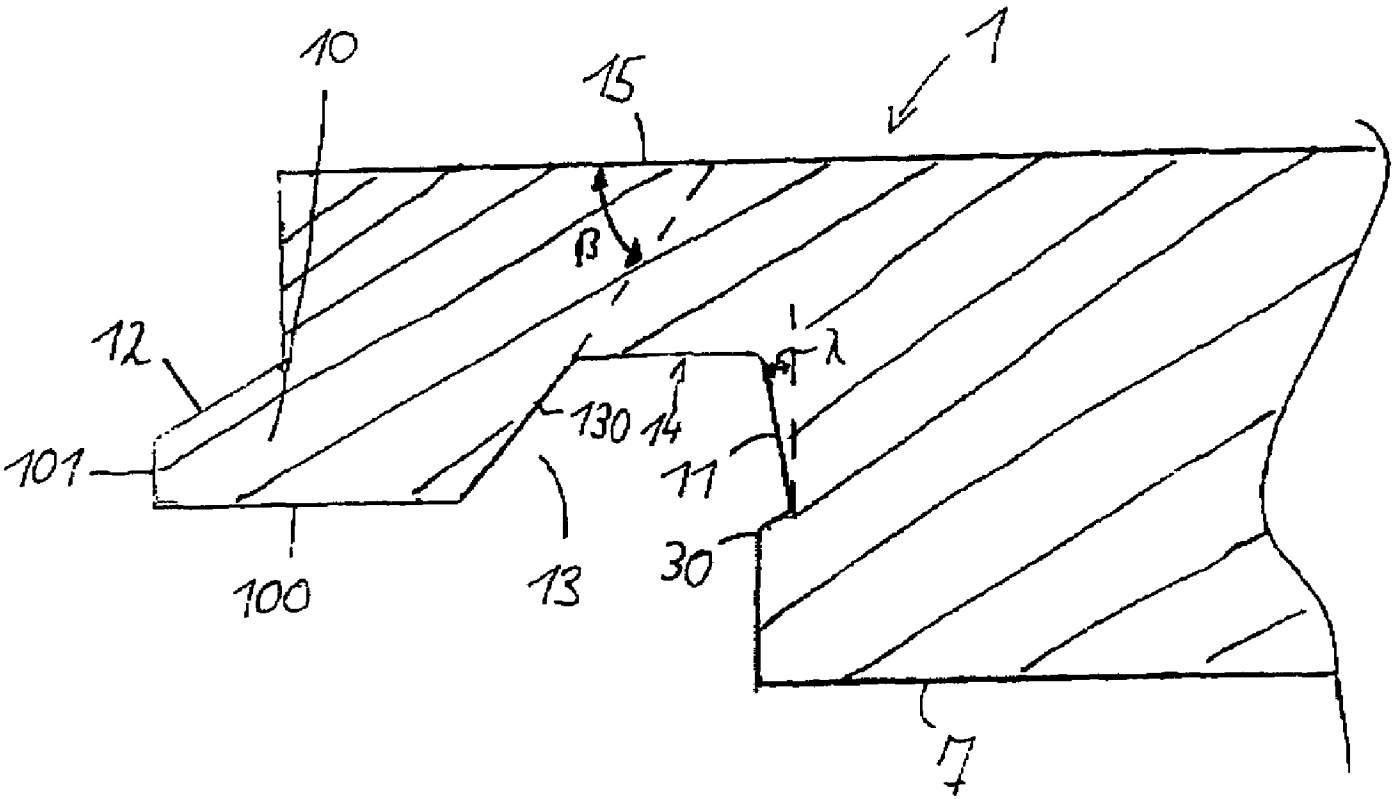
FIG. 1 shows a cross-sectional view of a panel with a first side edge.
Figure 2:
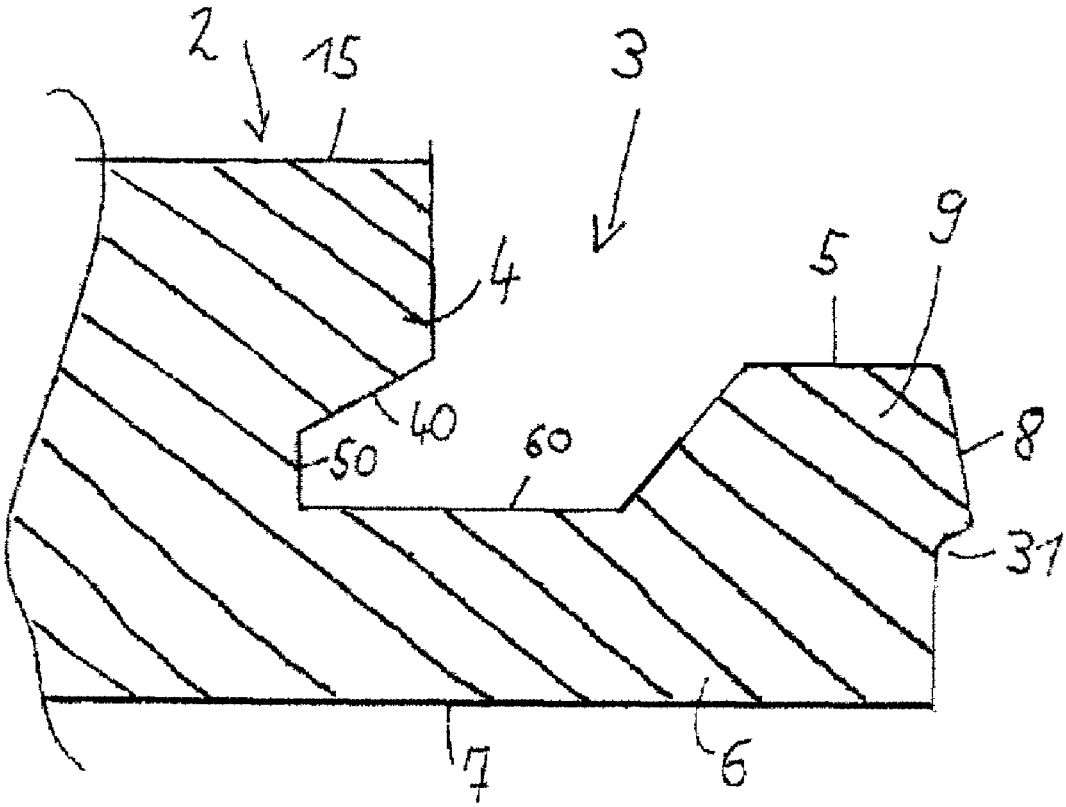
FIG. 2 shows a cross-sectional view of a panel with a second side edge.

FIGS. 1 and 2 show a floor panel 1 which comprises a medium-density or high-density fiberboard (MDF or HDF). On its top side 15, the floor panel 1 may be provided with a decorative layer 16 which may be formed, for example, by a paper layer which exhibits a woodgrain and is coated with a synthetic-resin layer serving to protect against wear. A sound-insulation layer may be adhesively bonded to the underside 7 in order to improve the footfall-sound properties of the laid floor panels. As an alternative to using an HDF or MDF board, the panel 1 may be produced from an OSB material (orientated strands board), it being possible in this case to dispense with a decorative layer 16. The panel 1 is provided with a tongue 10 on a first side edge, preferably on the longitudinal side of the panel 1, and with a recess 3 on the opposite, second side edge.

The recess 3 and the tongue 10 run over the entire length of the side edges. An outwardly projecting tip 101 with a vertical front side is provided on the tongue 10, the tongue 10 having an upwardly sloping, wedge-shaped contour. Extending from the tip 101 of the tongue 10 is a horizontal underside 100, which is adjoined by an undercut 13, which is formed by an inclined, rectilinear wall 130 which is inclined at an angle to the top side 15. A bearing region 14, which adjoins the wall 130, runs parallel to the top side 15 of the panels 1 and provides a favorable bearing surface for absorbing vertical forces. The bearing region 14 is bounded on the panel side by a wall 11 which is inclined slightly in relation to the vertical, the angle being an acute angle.

Figure 3:
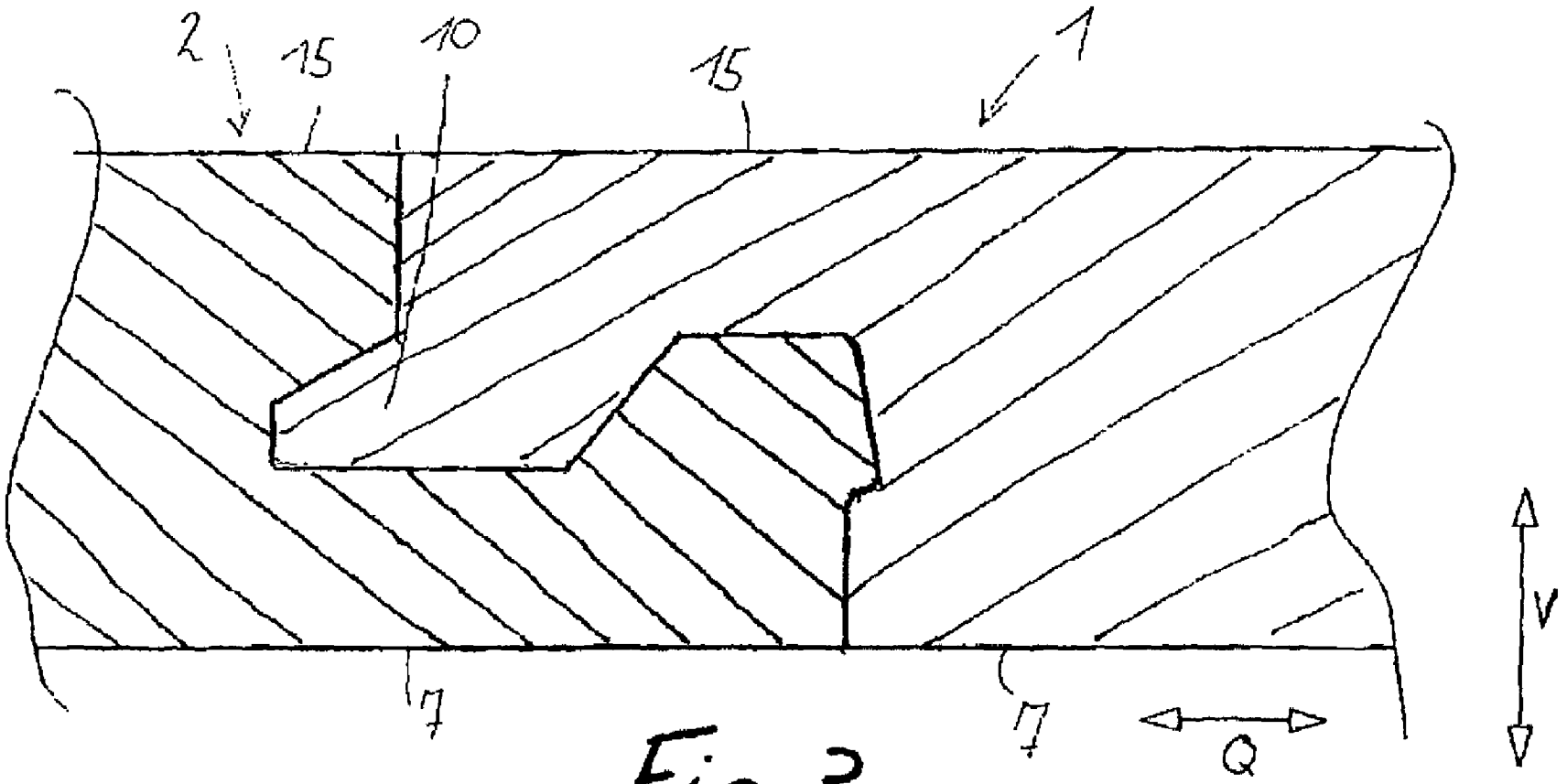
FIG. 3 shows a partial cross section of two panels connected to one another at the connecting location.

The undercut 13, as is shown in FIG. 3, brings about locking in the transverse direction Q, by form-fitting locking is produced with a corresponding shoulder 9 of the recess 3. In the installed state, the tongue 10 engages in an undercut formed by a top lip 4 of the recess 3, with the result that a rectilinear top side 12 of the tongue 10 butts against an underside 40 of the top lip and locking in the vertical direction V takes place along the first and second side edges. The shoulder 9 is formed on a bottom lip 6, which has a horizontal top side 60, of the recess 3 and terminates the latter, a horizontal shoulder surface 5 which serves as a support for the bearing region 14 being formed on the top side of the shoulder 9. The termination of the panel forms an inclined front shoulder side 8 which merges into the top shoulder side 5 via a rounded portion.

The top shoulder side 5 and the bearing region 14 provide a relatively large bearing surface, on which the two panels 1, 2 are located one upon the other in the connected state. The shoulder 9 is designed such that the front shoulder side 8 contains a recess 31 in which, as can be seen in FIG. 3, a corresponding protrusion 30 on the wall 11 of the first side edge engages. The recess 31 forms an undercut, with the result that form-fitting engagement of the protrusion 30 in the recess 31 produces locking in the vertical direction V.

The top side of the protrusion 30 rests on a corresponding slope of the recess 31, this ensuring precise angled positioning of the panels 1, 2. In addition to the form-fitting locking on the top side 12 of the tongue 10, the formation of the form-fitting elements 30, 31 provides a second locking point in the vertical direction, with the result that increased securing against the first panels 1, 2 pivoting back in an undesirable manner, in the present case in the anticlockwise direction, is achieved. The locking action is enhanced by the rectilinear configuration of the top side 12 of the tongue, the underside 40 of the top lip 4, the top side 60 of the bottom lip 6 and the underside 100 of the tongue 10, since the rectilinear configuration makes pivoting more difficult and the profile is retained in position on account of the elastic restoring force of the panels. Moreover, further securing is provided by virtue of the tip 101 of the tongue 10 and of the groove base 50 of the recess 3 being designed parallel to one another.

The operations of laying and locking two panels 1, 2 with such a profile takes place by virtue of the first panel 1 being positioned with the tongue 10 at an angle to the second panel 2 and by the tongue 10 being introduced into the recess 3 of the second panel 2. The angled first panel 1 is then pivoted about an axis parallel to the longitudinal direction of the first side edge, in the present case in the clockwise direction, with the result that the tongue 10 slides along in the correspondingly configured recess 3 until the top side 12 of the tongue butts against the corresponding underside 40 of the top lip 4. In this state, as is shown in FIG. 3, the undercut of the top lip 4 and also the shoulder 9 results in effective locking in the vertical direction V and in the transverse direction Q.

In order to allow locking with another panel not just on two opposite side edges of a panel, a profile which is illustrated in FIGS. 4-14 is formed on a third and a fourth side edge, which each run at an angle, preferably at right angles, to the first or second side edge. Here too, corresponding profiles are formed on opposite side edges, the interaction of which is explained in each case.

Figure 4:
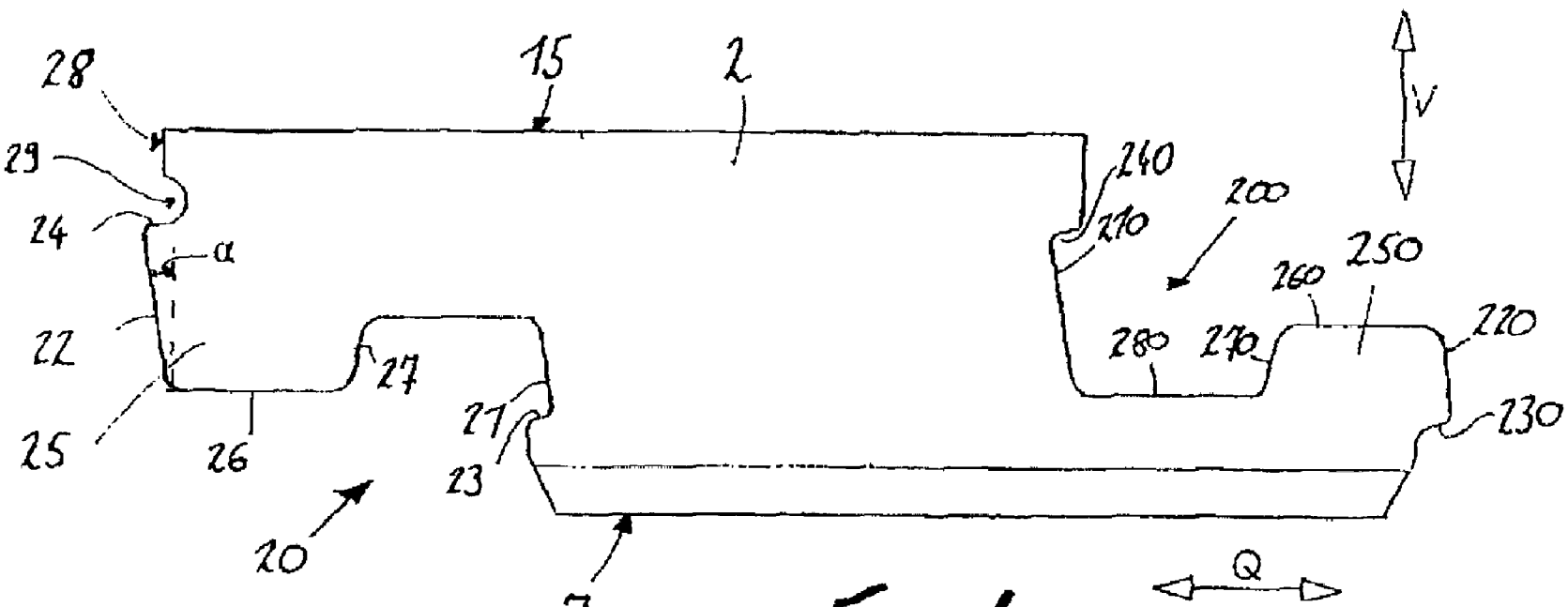
FIG. 4 shows a cross-sectional view of a floor panel with a third and a fourth side edge.

FIG. 4 shows a profile on a third side edge in cross section, this preferably being formed on the transverse side of the panels. A step-like milled relief 20 is made in the panel 2, starting from the underside 7, and forms an inner wall 21 and an outer wall 22. Form-fitting elements 23, 24 are formed on, in this case milled out of, the inner wall 21 and the outer wall 22, said elements engaging, in the form of protrusions, in corresponding undercuts 230, 240 of a corresponding recess 200 of a second panel 1. A shoulder 25 is formed in the milled relief 20 and projects in the direction of the underside 7, the outer shoulder wall being formed by the outer wall 22 and the inner shoulder wall 27, in the exemplary embodiment illustrated, forming an upwardly widening cross section. The underside of the shoulder 25 forms a head surface 26 which runs parallel to the top side 15 of the panels 2 and on which the panel 2 is supported, in the installed state, via a corresponding base surface 280 of a corresponding recess 200 of a second panel 1.

As an alternative to the embodiment illustrated, it is provided that the inner surface 27 runs essentially parallel to the outer wall 22, with the result that the inner shoulder wall 27 forms an undercut in relation to the head surface 26. Provision is likewise made for the outer wall 22, in addition to being designed essentially rectilinearly at an acute angle $\alpha$ to the vertical, to be rounded or to run vertically. It is necessary here for the form-fitting element 24 to project beyond the termination edge 28 of the top side 15, in order to carry out form-fitting locking with the second panel 1.

A recess 29 is formed above the form-fitting element 24 and acts as a dust pocket.

If the inner shoulder wall 27 is designed as an undercut in relation to the head surface 26, additional vertical locking is provided, in particular if the corresponding inner shoulder wall 270 of the upwardly directed shoulder 250 is likewise designed as an undercut. Form-fitting locking then takes place by the profiles being bent up slightly or elastically deformed, with the result that the form-fitting elements 23, 24 and the undercut provided by the inner shoulder wall 27 can pass into effective engagement with the corresponding undercuts 230, 240 and the undercut provided by the inner shoulder wall 270.

Figure 5:
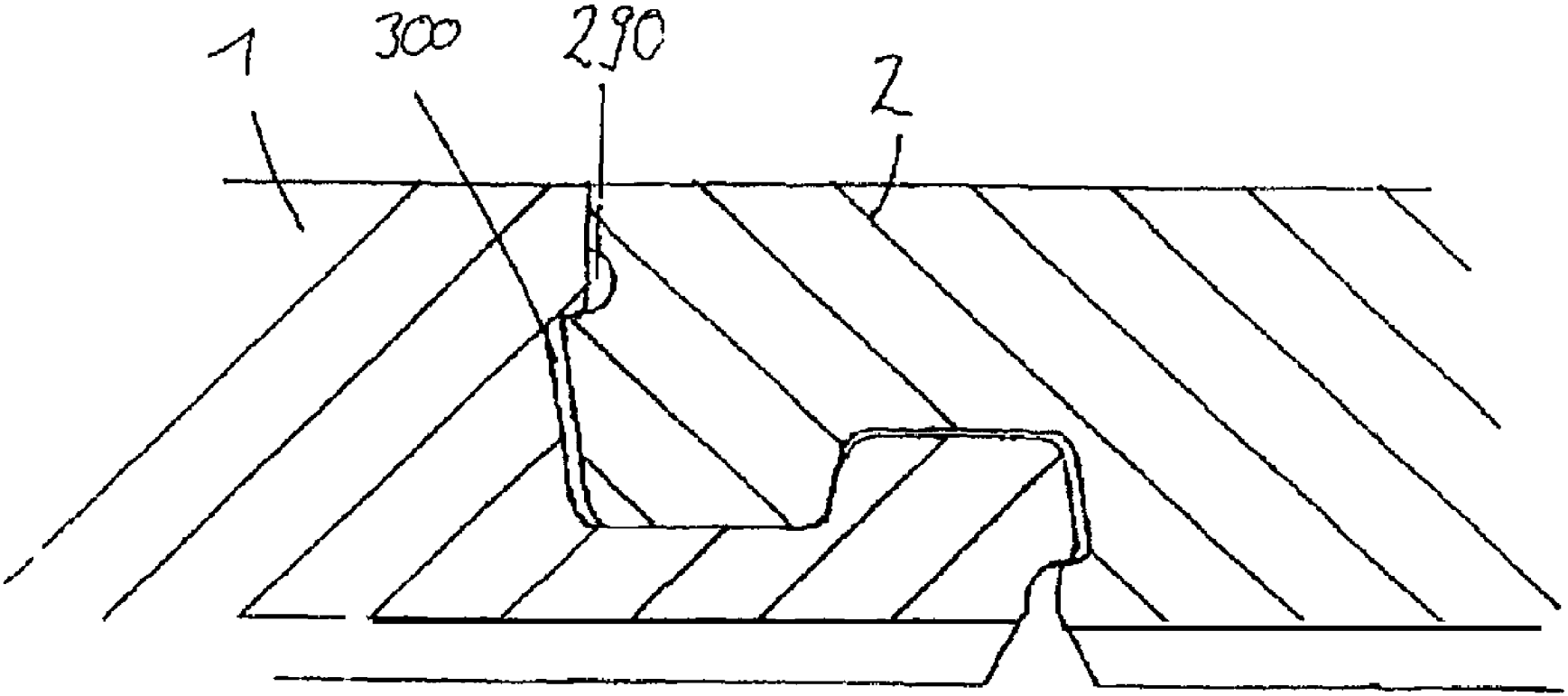
FIG. 5 shows two panels connected to one another according to FIG. 3 at a connecting location of the third and fourth side edges.

The milled relief 200, which starts from the top side 15, is designed such that it can accommodate the opposite profile, with the result that, on the one hand, the head surface 26 rests in a completely planar manner on the base surface 280 and, on the other hand, the surfaces 15 of the two panels 1, 2 in the installed state, as is illustrated in FIG. 5, terminate in a single plane and are positioned, as far as possible, flush one against the other. The recess 29 above the form-fitting element 24 creates a free space 290 which serves as a dust pocket; the same applies to the free space 300, which is formed by a corresponding positioning of the inner wall 210 of the milled relief 200.

As can clearly be seen in FIG. 5, effective locking is provided both in the transverse direction Q and in the vertical direction V, the locking in the transverse direction Q being realized with form-fitting action by the shoulders 25, 250. Locking in the vertical direction V takes place by way of the locking elements 23, 24, which engage with form-fitting action in the undercuts 230, 240, the form-fitting elements 23, 24 being arranged on spaced-apart walls 21, 22. Furthermore, the form-fitting elements 23, 24 are arranged on different vertical levels, this resulting in the formation of a top locking point and a bottom locking point. The top locking point is formed by the form-fitting element 24 and the undercut 240, and the bottom locking point is formed by the form-fitting element 23 and the undercut 230.

The upwardly directed shoulder 250, rather than being formed over the entire length of the third side edge, is milled off over a region down to the base surface 280, this milling being provided in the direction of the first side edge with a tongue. By virtue of this milling out or non-formation of the shoulder 250, it is possible, during laying of the panels, for the initially angled panel to be lowered further downward before an abrupt installation movement in the downward direction gives rise to definitive locking via the third side edge, preferably the transverse side.

In the installed state, there is a free space between the head surface 260 of the shoulder 250 and the corresponding surface of the milled relief 20, this free space being necessary in order that the form-fitting element 23 can engage behind the undercut 230. This free space likewise serves as a dust pocket.

In addition to a panel being designed with a recess 3, having a top lip 4 and a bottom lip 6, on one side edge, it is also possible, by virtue of a corresponding profile configuration, to dispense with a bottom lip 6 if locking in the transverse direction Q and vertical direction V is ensured in some other way. This locking takes place such that, in the locked state, there is no possibility of any movement in the direction of the double arrows.

The presented profile and the laying method described allow panels to be laid easily and quickly. The profile also has the advantage that the specific configuration of the tongue 10 and of the recess 3 gives rise, on the one hand, to easy pivoting in and locking and, on the other hand, to a stable bearing arrangement and thus the possibility of the vertical offset being set as precisely as possible. There is likewise secure locking of the first side edges in the vertical direction V and transverse direction Q, and this profile can be milled to particularly good effect into OSB panels.

The profile configuration on the third side edge allows particularly durable form-fitting locking on the third and fourth side edges, preferably the transverse sides, of the panels, without there being any need for high-outlay auxiliary devices or particular skills for installation purposes. In addition to the offset form-fitting elements, the large bearing surface prevents angling and thus easy opening of the locking on the third side edge. Furthermore, the form-fitting locking, which produces a characteristic sound, indicates to the user of the panels that effective locking has taken place.

Figure 6:
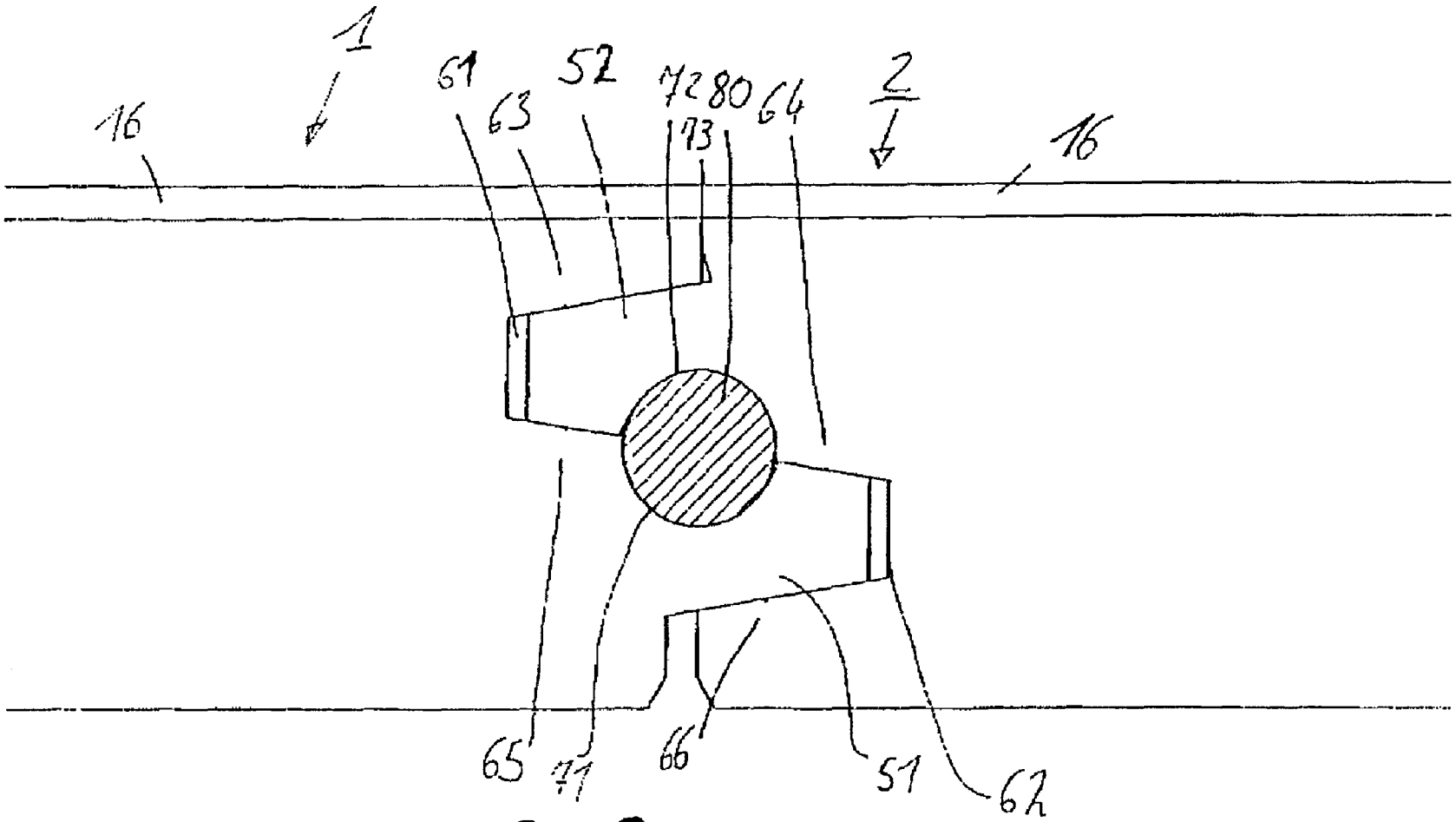
FIG. 6 shows a partial cross section of an alternative configuration of the third and fourth side edges.

FIG. 6 shows a configuration of the third and fourth side edges of the panels 1, 2, the two panels each being designed with a tongue 51, 52 and a groove 61, 62. The tongues 51, 52 and the grooves 61, 62 are offset vertically in relation to one another such that the tongues 51, 52 can engage in the corresponding grooves 62, 61 in order thus to produce locking in the transverse direction Q. In order to realize corresponding locking, the panels are first of all locked on the first side edges and then displaced in relation to one another in the transverse direction Q until the end position illustrated has been achieved, with a minimal joint 73 being formed in the process.

The joints 61, 62 are formed in each case by a first lip 63, 64 and a second lip 65, 66, the second lip 65 of the first panel 1 projecting beyond the first lip 63 in the transverse direction Q. The reverse is the case with the second panel 2: the first lip 64 projects beyond the second lip 66 in the transverse direction Q, the respectively projecting lips 64, 65 merging into the respective underside or top side of the tongues 52, 51.

In the exemplary embodiment illustrated, a corresponding, duct-like, cross-sectionally semicircular recess 71, 72 is milled in each case into the bottom, second lip 65 of the first panel and the top, first lip 64 of the second panel, these recesses, in the installed state illustrated, forming a channel 75. A separate locking element 80, preferably made of plastic, is pushed into this channel 75 to produce form-fitting locking in the transverse direction Q. By virtue of an elastic configuration of the locking element 80 and of slight over-dimensioning, it is possible for the panels 1, 2 to be braced in relation to one another, with the result that the joint 73 can always be kept minimally small. Prestressing between the panels 1, 2, once laid, is produced by virtue of the locking element 80 being pushed in, which results in secure positioning of the panels 1, 2 in relation to one another and in a minimal surface offset. The joint 73 is likewise kept closed, with the result that it is not possible for any dirt or any moisture to penetrate, and the core of the panels 1, 2 yields.

The recesses 71, 72 are arranged such that the channel 75 or the locking element 80 runs parallel to, and beneath, the joint 73, as a result of which, on the one hand, optimum production is possible on account of the more or less symmetrical design, since a milling-out operation only has to take place in part within the corresponding grooves 61, 62 and, on the other hand, there is still sufficient material present for absorbing corresponding forces in the panel material.

Figures 7, 8, 9, 10:
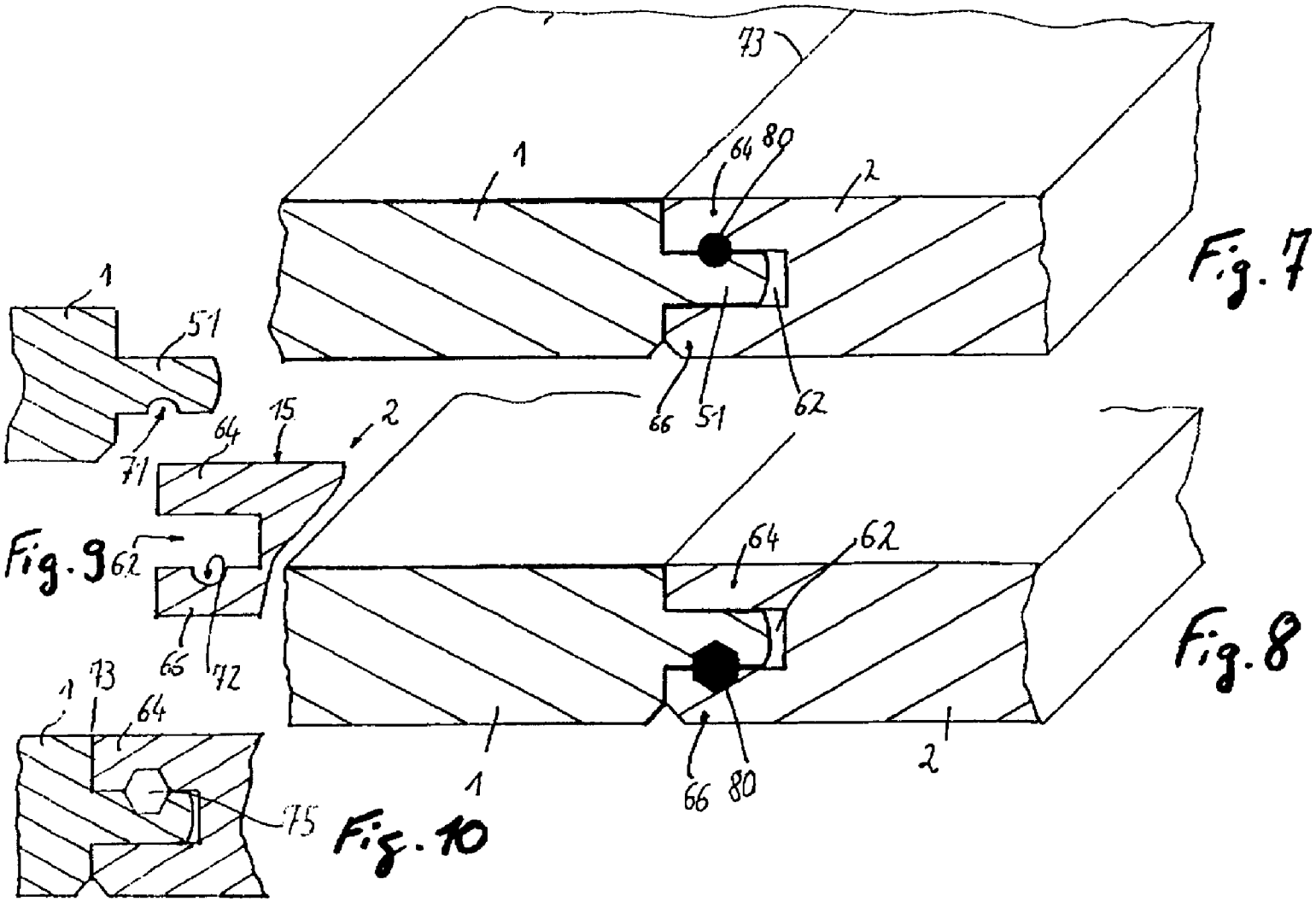
FIG. 7 shows two locked panels with a third embodiment on the third and fourth side edges.
FIG. 8 shows two locked panels in a fourth embodiment of the third and fourth side edges, in section.
FIG. 9 shows the configuration of the tongue and groove in a fifth embodiment.
FIG. 10 shows the configuration of the tongue and groove in a sixth embodiment.

FIG. 7 shows a variant of the profile configuration on the third and fourth side edges of the panels 1, 2, a tongue 51 being formed along the respective side edge of the first panel 1 and a groove 62 being formed along the respective side edge of the second panel. Cross-sectionally semicircular recesses are milled both into the top side of the tongue 51 and into the first lip 64 of the groove 62, these recesses producing a cylindrical channel 75 when the two panels 1, 2 are joined together. A tube which has been extruded from plastic and cut to the appropriate length can be pushed, as locking element 80, into this channel 75, with the result that locking in the transverse direction Q takes place via the locking element 80. The groove 62 and tongue 51 lock the panels 1, 2 in the vertical direction.

FIG. 8 illustrates a variant of FIG. 7, in the case of which the corresponding recesses 71, 72 are formed on the underside of the tongue 51 and on the second lip 66 of the groove 62, respectively. The recesses 71, 72 are designed to correspond to one another, with the result that a hexagonal locking element 80 is formed into the correspondingly designed channel 75. The channel 75 is illustrated in FIG. 9, and the corresponding configuration of the recesses 71, 72 and of the groove 62 and of the tongue 51 according to FIG. 7 are illustrated in FIG. 9.

The operation of laying the panels 1, 2 with a profile configuration according to FIGS. 4 to 10 on the third and fourth side edges takes place by, in the first instance, on the first side edge of a panel being introduced and pivoted into a second side edge until the panels which are to be connected on the third and fourth side edges are located in a single plane. The panels are then displaced toward one another along the first side edge until they butt against one another and form a minimal joint 73. At the same time, the recesses 71, 72 form a channel 75, into which a correspondingly shaped locking element 80 is pushed. This results in effective locking in the vertical direction and in the transverse direction Q.

Following removal of the locking element 80, it is possible for the panels to be detached without the profiles being destroyed, with the result that any desired number of laying operations can be carried out. Such a locking configuration is suitable, in particular, for (trade-) fair construction elements.

Figure 13:
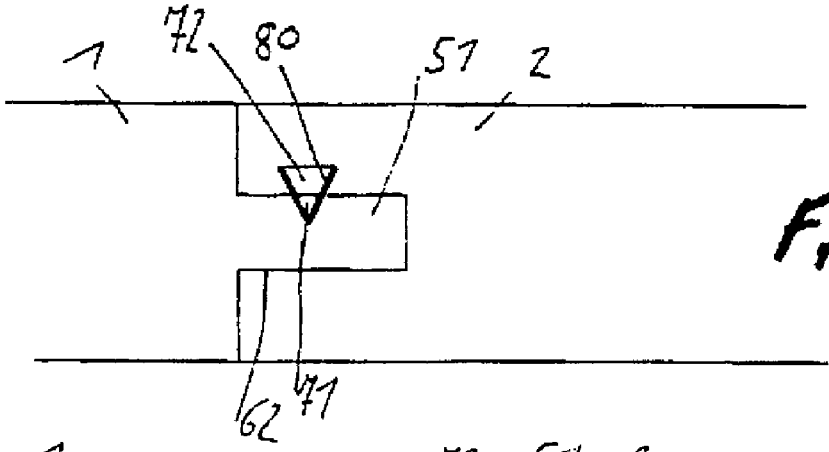
Figure 14:
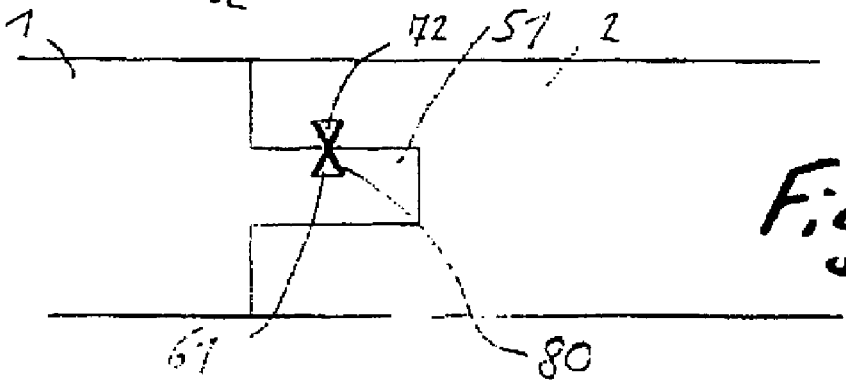

FIGS. 13 and 14 illustrate further configurations of the recesses 71, 72, which can likewise be laid using the above-described method. In FIG. 13, the channel 75 has a triangular cross section, the top recess 72 having the cross section of an isosceles trapezoid and the bottom recess 71 in the tongue 51 being triangular. The locking element 80 is of V-shaped design and, by virtue of elastic prestressing, can produce a corresponding force component in the transverse direction Q, with the result that the panels 1, 2 are moved toward one another.

In FIG. 14, in each case two cross-sectionally triangular milled reliefs 71, 72 have been milled into the tongue 51 and groove 62, respectively, and the locking element 80 has an X-shaped cross section. As a result of the locking elements 80 according to FIGS. 13 and 14 being pushed in, the legs are compressed and, in addition, keep the joint 73 tight and thus sealed in relation to dirt and moisture. In order to make it easier for them to be pushed in, the locking elements 80 are tapered at their ends.

Figure 11:
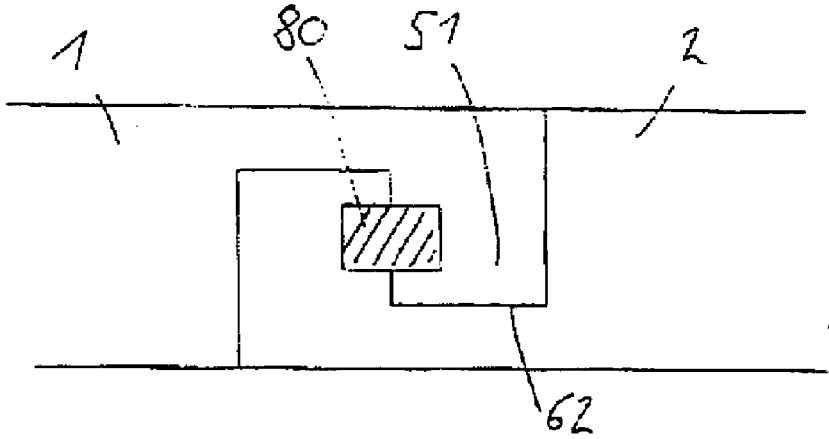
Figure 12:
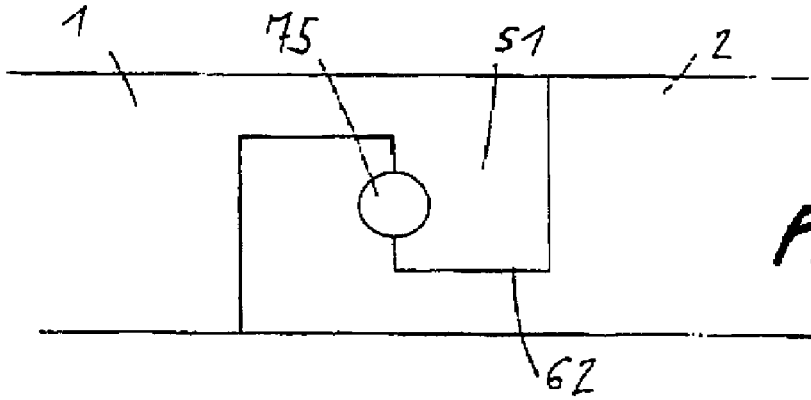

In FIGS. 11 and 12, the groove 62 and the tongue 51 are designed such that locking in the transverse direction Q takes place by interengagement of the groove 62 and tongue 51. Corresponding recesses are milled into the vertical edges of the groove 62 and tongue 51, and a locking element 80 can be pushed into the same. In FIG. 11, these recesses are designed such that a rectangular locking element 80 is pushed in.

FIG. 12 illustrates a variant of FIG. 11, in the case of which the channel 75 is circular. Such a configuration of the third and fourth side edges of the panels 1, 2 results in effective locking in the transverse direction Q just by the tongue 51 being introduced into the groove 62. The geometry illustrated provides a very high-level bearing surface, with the result that forces can be absorbed and channeled away to good effect. The recesses 71, 72 are likewise relatively easy to produce, in particular to mill out, and just one tool is required for the two side edges. Furthermore, with a corresponding configuration of the locking elements 80, a pressure, which moves the panels 1, 2 toward one another and braces them, is built up. Secure locking in the vertical direction V is likewise ensured.

It is also possible for the locking elements 80 and the grooves and tongues to have different geometries, the locking element or the locking elements eliminating that movement component which is not blocked by the tongue/groove connection. The locking element advantageously braces the panels in relation to one another, with the result that the joint is minimized. The channel for the introduction of the locking element here can run over the entire joint width or groove width; all that is required is to provide corresponding form-fitting elements in order to bring about locking.

The invention claimed is:

1. A floor panel which is bounded in a horizontal plane by a top side and an underside, provided for resting on an underlying surface, and which is provided with structure for releasably connecting at least two panels, a tongue is formed on at least one first side edge of a first panel, the tongue extending in the longitudinal direction of the first side edge, and a recess which corresponds to the tongue is formed on the opposite, second side edge, the recess comprises a top lip and a bottom lip, and the bottom lip forms a shoulder with a top shoulder side and a front shoulder side, said shoulder, with a corresponding undercut of the tongue, blocking connected panels in the transverse direction Q, the undercut is adjoined by a recess, with a bearing region which consists of a planar horizontal surface and which corresponds to the top shoulder side, and a wall that is inclined at an acute angle relative to vertical and at an obtuse angle relative to the bearing region, the wall in the laid state is located opposite the front shoulder side, and corresponding form-fitting elements are formed on the wall and the front shoulder side, said form-fitting elements, in the laid state, engaging one inside the other at respective surfaces that are inclined at acute angles relative to horizontal and bringing about locking of the connected panels in the vertical direction V, wherein the tongue comprises:

a flat vertical surface between an upper edge and a lower edge at a distal end of the tongue, a sloped surface extending upward from the upper edge of the flat vertical surface at an obtuse angle relative to the flat vertical surface, a downward facing underside extending from the lower edge of the flat vertical surface, and an inclined wall extending upward from the downward facing underside to the bearing portion at an acute angle relative to the top side and at an obtuse angle relative to the downward facing underside, and wherein the underside of the tongue and a top side of the bottom lip extends parallel to the top side.

2. The floor panel according to claim 1, wherein a protrusion is formed on the wall and a recess is formed on the front shoulder side.

3. The floor panel according to claim 2, wherein a top side of the protrusion and an underside of the recess are correspondingly sloped.

4. The floor panel according to claim 1 wherein, in the installed state, a top side of the tongue butts against an underside of the top lip.

5. The floor panel according to claim 1, wherein the tongue is designed such that locking takes place by an introduction movement into the recess of the second panel and a pivoting-in movement about an axis parallel to the first side edge.

6. The floor panel according to claim 1, wherein the tongue and the recess have a wedge-shaped contour in cross section.

7. The floor panel according claim 1 wherein the tongue and the recess are designed such that, in the installed state, a gap is present between the front region of the tongue and that region of the recess which adjoins the top lip.

8. The floor panel according to claim 1, wherein the distal end of the tongue is perpendicular to the top side and a groove base of the recess is perpendicular to the top side.

9. The floor panel according claim 1, wherein form-fitting elements for locking in the vertical direction V with a further panel are formed on a third side edge, which runs at an angle to the first side edge, the form-fitting elements being spaced apart from one another in the transverse direction Q and in the vertical direction V on two spaced-apart, essentially vertically oriented walls.

10. The floor panel according to claim 9, wherein a step-like milled relief which starts from the underside and has an inner wall and an outer wall is formed on the third side edge, in each case one form-fitting element which extends in the transverse direction Q being formed on the walls and in that formed on the fourth side edge which is located opposite the third side edge is a step-like milled relief which starts from the top side and has an inner wall and an outer wall, on which are formed undercuts which correspond with the form-fitting elements.

11. The floor panel according to claim 10, wherein the step-like milled relief which starts from the underside forms a shoulder which projects in the direction of the underside and has an essentially horizontally oriented head surface.

12. The floor panel according to claim 11, wherein the walls of the shoulder are oriented at an acute angle $\alpha$ in relation to the head surface.

13. The floor panel according to claim 12, wherein the inner shoulder wall forms an undercut in relation to the head surface.

14. The floor panel according to claim 11, wherein the head surface has a transverse extent of 2 to 6 mm.

15. The floor panel according to claim 11, wherein the head surface has 0.25 to 0.4 times the overall transverse extent of the step-like milled relief.

16. The floor panel according to claim 10, wherein the step-like milled relief, which starts from the top side, forms a shoulder which projects in the direction of the top side and has an essentially horizontally oriented head surface, the bottom region of the outer shoulder wall containing an undercut which corresponds with the form-fitting element of the inner wall of the milled relief of the opposite side edge.

17. The floor panel according to claim 16, wherein a horizontal base surface is formed between the inner shoulder wall and the inner wall of the milled relief, said base surface being designed such that, when the panels, have been laid, the head surface rests on the base surface and the top sides of the panels, are located in a single plane.

18. The floor panel according to claim 16, wherein the inner shoulder wall runs parallel to, or at a shallower angle than, the corresponding inner shoulder wall of the shoulder, which engages in the laid state.

19. The floor panel according to claim 16, wherein the inner shoulder wall forms an undercut in relation to the head surface.

20. The floor panel according to claim 16, wherein the upwardly projecting shoulder is formed on less than an entire length of the third side edge.

21. The floor panel according to claim 9, wherein a form-fining element of the third side edge projects horizontally beyond the termination edge of the top side.

22. The floor panel according to claim 21, wherein a recess, which undercuts the termination edge, is arranged between the top side and the projecting form-fitting element.

23. The floor panel according to claim 1, wherein at least one tongue is formed on a third side edge, which runs at an angle to the first side edge, and at least one groove with a first lip and a second lip is formed on an opposite, fourth side edge, in each case at least one recess which runs parallel to the top side being arranged on the tongue and at least on one of the lips and the recesses being arranged in relation to one another such that, when the panels have been connected to one another, they form a channel for accommodating a separate locking element.

24. The floor panel according to claim 23, wherein the channel is of cylindrical, triangular or quadrilateral, polygonal, x-shaped or v-shaped design.

25. The floor panel according to claim 23, wherein the channel runs over the entire length of the groove and tongue.

26. The floor panel according to claim 23, wherein the channel runs beneath and parallel to a joint of the panels.

27. The floor panel according to claim 23, wherein the groove and the tongue are configured such that they bring about locking in the transverse direction Q.

28. The floor panel according to claim 23, wherein the channel is of cylindrical, triangular, x-shaped or v-shaped design.

29. The floor panel according to claim 23, wherein the channel runs beneath and parallel to a joint formed by two upper termination edges of the panels.

30. The floor panel according to claim 1, wherein the first and second side edges are formed on the longitudinal side, and third and fourth side edges are formed on the transverse side, of the panel.

31. The floor panel according to claim 1, wherein third and fourth side edges are formed on the longitudinal side, and the first and second side edges are formed on the transverse side, of the panel.

32. The floor panel according to claim 1, wherein the panels are made from HDF, MDF or an OSB material.

33. The floor panel according to claim 32, wherein no decorative layer is applied to the top side.

34. The floor panel according to claim 1, wherein an upward facing rectilinear surface of the tongue extends from a distal end of the tongue toward the top side of the panel.

35. The floor panel according to claim 1, wherein the undercut comprises a rectilinear wall that is inclined relative to the top side.

36. The floor panel according to claim 1, further comprising a decorative layer applied to the top side and a sound insulation layer adhesively bonded to the underside.

37. A floor panel, comprising:

a top side and a bottom side;

a first side edge comprising:

a tongue having a tip at a distal end of the tongue which comprises a flat vertical surface extending between an upper edge and a lower edge;

a sloped surface extending upward from the upper edge of the tongue toward the top side at an obtuse angle relative to the flat vertical surface;

a downward facing underside extending from the lower edge of the flat vertical surface;

an inclined wall extending upward from the downward facing underside to a bearing portion which consists of a planar horizontal surface, the inclined wall being inclined at an acute angle relative to the top side, the inclined wall also being inclined at an obtuse angle relative to the downward facing underside;

the bearing portion extending between the inclined wall and a side wall, the side wall being inclined at an acute angle relative to vertical and at an obtuse angle relative to the bearing portion; and an upward facing protrusion formed on the side wall;

a second side edge, parallel to and opposite the first side edge, comprising:

a recess formed by a top lip and a bottom lip;

the top lip comprising a downward facing surface arranged and adapted to abut a corresponding sloped surface of another panel for locking the panels in a vertical direction; and the bottom lip comprising a front shoulder side arranged and adapted to abut a corresponding side wall of the other panel, and a sloped recess formed on the front shoulder side arranged to engage a corresponding upward facing protrusion of the other panel for locking the panels in the vertical direction, wherein the sloped recess faces away from the panel and is inclined at an acute angle relative to horizontal.

38. The floor panel of claim 37, wherein an inclined surface of the bottom lip is arranged to abut the inclined wall of the other panel for locking the panels in a vertical direction.

39. The floor panel of claim 37, wherein the downward facing underside and the bearing portion are horizontal.

40. The floor panel of claim 39, wherein the downward facing underside and the bearing portion are arranged on different levels in the vertical direction.

41. The floor panel of claim 37, wherein the tongue is wedge-shaped.

42. The floor panel of claim 37, wherein the panel is made from MDF or HDF, and further comprising a decorative layer provided on the top side.

43. The floor panel of claim 37, wherein the panel is made of OSB material, and is devoid of a decorative layer on the top side.

44. The floor panel of claim 37, further comprising:

a third side edge arranged at an angle to the first side edge, comprising:

a first protrusion having a first upward facing surface; and a second protrusion having a second upward facing surface, wherein the first protrusion and the second protrusion are spaced apart in the transverse direction and the vertical direction;

a fourth side edge, parallel to and opposite the third side edge, comprising:

a first undercut having a first downward facing surface; and a second undercut having a second downward facing surface;

wherein, in an assembled state with a corresponding panel, the first upward facing surface engages the first downward facing surface for locking the panels in the vertical direction, and the second upward facing surface engages the second downward facing surface for locking the panels in the vertical direction.

45. The floor panel of claim 44, wherein the first protrusion is formed on a wall that is inclined at an acute angle relative to vertical.

46. The floor panel of claim 44, further comprising a recess formed inward from the first protrusion.

47. The floor panel of claim 46, wherein the recess is formed between the first protrusion and a termination edge of the third side edge, and the recess acts as a dust pocket for connected panels.

48. The floor panel of claim 37, further comprising:

a third side edge arranged at an angle to the first side edge, comprising a tongue including a first recess formed in the tongue; and a fourth side edge, parallel to and opposite the third side edge, comprising a groove including a second recess formed in a surface of the groove, wherein, in an assembled state with a corresponding panel, the first recess and the second recess cooperate to form a channel arranged to receive a separate locking element.

49. The floor panel of claim 48, wherein the channel has a cross-sectional shape of a circle, a triangle, or a hexagon.

* * * * *